US009408479B2

(12) United States Patent
Hasbany

(10) Patent No.: US 9,408,479 B2
(45) Date of Patent: Aug. 9, 2016

(54) JEWELRY HOLDER

(71) Applicant: Cynthia J. Hasbany, Sylvan Lake, MI (US)

(72) Inventor: Cynthia J. Hasbany, Sylvan Lake, MI (US)

( * ) Notice: Subject to any disclaimer, the term of this patent is extended or adjusted under 35 U.S.C. 154(b) by 79 days.

(21) Appl. No.: 14/270,704

(22) Filed: May 6, 2014

(65) Prior Publication Data

US 2014/0332648 A1 Nov. 13, 2014

Related U.S. Application Data

(60) Provisional application No. 61/820,422, filed on May 7, 2013.

(51) Int. Cl.
*A47F 7/02* (2006.01)

(52) U.S. Cl.
CPC ..... *A47F 7/02* (2013.01)

(58) Field of Classification Search
CPC ..... A44C 3/008; A47G 25/0607; A47K 1/09; Y10T 24/392
See application file for complete search history.

(56) References Cited

U.S. PATENT DOCUMENTS 257,533 A * 5/1882 Taylor ..... A47G 25/0607 248/303
353,716 A * 12/1886 Spencer ..... A47K 1/09 211/65
372,099 A * 10/1887 Williamson ..... A47G 25/0607 248/218.2
389,825 A * 9/1888 Thurston ..... A47G 25/0607 248/218.2
396,756 A * 1/1889 Miles ..... A47G 25/0607 248/218.2
397,157 A * 2/1889 Van Wagoner ..... A47G 25/0607 248/218.2
417,129 A * 12/1889 Wright ..... A47G 25/0607 24/131 R
509,629 A * 11/1893 Taylor ..... F16B 2/248 24/131 R
540,044 A * 5/1895 Carnell ..... A47G 25/0607 248/303
761,739 A * 6/1904 Williamson ..... A47G 25/0607 248/218.2
767,123 A * 8/1904 Quinn ..... A47G 25/0607 211/106.01
837,871 A * 12/1906 McConnell et al. ..... A47K 1/09 211/65
873,762 A * 12/1907 Lyons ..... A47K 1/09 211/65
878,068 A * 2/1908 Jones ..... A47K 1/09 211/65
927,483 A * 7/1909 Bradley ..... A47G 25/0607 248/303
972,501 A * 10/1910 Brewer ..... A47G 25/0607 248/218.2
1,031,390 A * 7/1912 Smith ..... A47G 25/0607 248/218.1
1,134,813 A * 4/1915 Best ..... A47K 1/09 211/65
1,300,908 A * 4/1919 Williams ..... A47G 25/0607 211/106

(Continued)

*Primary Examiner* — Bradley Duckworth
(74) *Attorney, Agent, or Firm* — The Dobrusin Law Firm, P.C.

(57) ABSTRACT

A jewelry holder may include a shaft having a first section and a second section. The first section may include two spaced members defining a gap. The spaced members may be configured to receive an item. The second portion may secure the first portion.

18 Claims, 2 Drawing Sheets

(56) References Cited

U.S. PATENT DOCUMENTS 1,365,354 A * 1/1921 Thayer ..... A47G 25/0607 248/303
1,368,754 A * 2/1921 Reinhard ..... D06F 53/00 24/131 R
1,445,372 A * 2/1923 Wagner ..... A47G 25/0607 211/106.01
1,467,553 A * 9/1923 Mistrot ..... A47G 25/0607 211/32
1,664,109 A * 3/1928 Howden ..... A47K 1/09 248/113
1,696,753 A * 12/1928 Clarke ..... A47G 25/0607 211/32
1,720,746 A * 7/1929 Povlsen ..... H02G 3/26 24/131 R
1,795,059 A * 3/1931 Vance ..... A47G 25/0607 248/304
1,855,049 A * 4/1932 Harvey ..... D06F 53/00 211/119.15
1,961,054 A * 5/1934 Laseter ..... A47K 1/09 248/113
1,964,849 A * 7/1934 Gordon ..... F16L 3/00 24/131 R
2,205,496 A * 6/1940 Schneider ..... A47G 33/10 211/112
2,240,225 A * 4/1941 Place ..... A47G 25/0607 248/222.51
2,505,306 A * 4/1950 Schmidt ..... A47G 25/1478 248/215
2,518,179 A * 8/1950 Quinby ..... A01K 15/003 119/805
2,564,260 A * 8/1951 Houser ..... A01K 91/18 24/131 R
2,707,052 A * 4/1955 Brown ..... A47K 1/09 211/120
2,900,689 A * 8/1959 Pearson ..... B63B 21/06 114/218
3,902,227 A * 9/1975 Sherwood ..... B63B 21/08 24/115 J
D269,770 S * 7/1983 Pittenger ..... D11/87
5,210,912 A * 5/1993 Hoefkes ..... F16G 11/00 24/129 C
5,402,555 A * 4/1995 Boland ..... F16G 11/00 24/129 C
6,848,270 B2 * 2/2005 White ..... A44C 3/008 24/131 C
8,701,899 B2 * 4/2014 Paga ..... A47F 5/01 211/181.1
D716,684 S * 11/2014 Hasbany ..... D11/87

* cited by examiner

JEWELRY HOLDER

CROSS-REFERENCE TO RELATED APPLICATIONS

This application claims the benefit of U.S. Provisional Patent Application No. 61/820,422, filed May 7, 2013, the contents of which are incorporated herein in their entirety.

BACKGROUND

Jewelry, such as earrings, navel rings, etc., can be difficult to store. Pieces of the jewelry can become lost without proper storage. Men and women have historically depended upon a jewelry box as a place to store jewelry when not being worn. Typically, jewelry boxes may store multiple jewelry items in a more-or-less organized manner. However, often individual jewelry items become entangled with one another during transport or storage. Thus, a need exists for a simple and effective solution to this problem.

Further, organizational and storage problems often result when attempting to display multiple pieces of jewelry on a backing or board. One style of traditional jewelry holding devices used to display jewelry items on a board includes a J-shaped hook. However, a problem with holding devices of this type is that the hook only accommodates items with annular or ring-shaped structures which have to be inserted into the hook region to hang therefrom. Accordingly, the J-shaped hook fails to store and display various types of jewelry items that do not have annular or ring-shaped structures. There is a need for a jewelry holder that can accommodate jewelry items without annular structures for display.

Additionally, it is often difficult to quickly and easily adjust jewelry holding devices associated with a particular jewelry box or board. Many traditional jewelry holding devices are permanently fixed to the jewelry box and thus are not replaceable or adjustable if desired. Accordingly, there is a need to conveniently store jewelry so as to preserve and display the jewelry.

DETAILED DESCRIPTION

Disclosed is a jewelry holder for displaying various jewelry items such as earrings, navel rings, necklaces, bracelets, etc. While the examples discussed herein are directed to a jewelry holder for holding a navel ring, this is merely exemplary and is not meant to be limiting. The jewelry holder may be used in an associated jewelry holder assembly and may have at least one holder integrally connected with a backing. The holder may be configured to receive a portion of a jewelry item, such as a top ball of a navel ring, at a pair of spaced members, while allowing the rest of the ring to hang therefrom. Thus, a convenient device for displaying, storing and preserving the jewelry is achieved.

Figure 1:
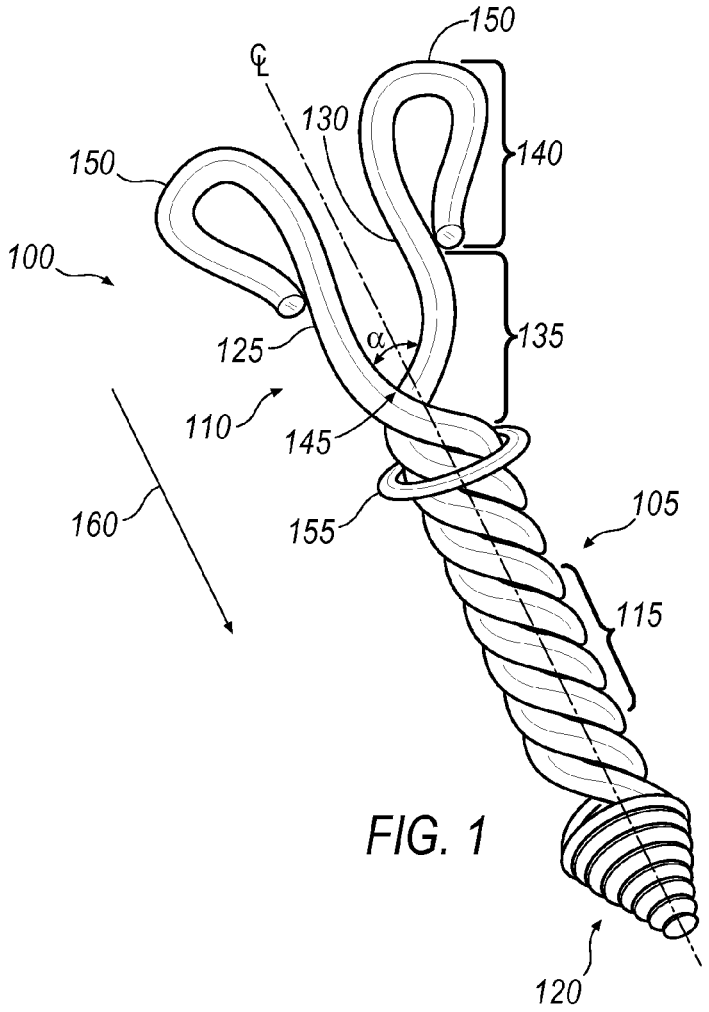
FIG. 1 illustrates a perspective side view of a jewelry holder according to one example.

Referring to FIG. 1, an exemplary jewelry holder 100 is shown. The jewelry holder 100 may include an elongated body 105 and a head 110. Stated alternatively, FIG. 1 may illustrate a shaft 100 having a first section 105 and a second section 110. The body 105 may be configured for insertion into a complementary display member, and may include attributes for easily and securely inserting the holder 100. For instance, the body 105 may include helical ridges or external threads 115 to enable convenient insertion and proper securement of the holder 100 into a backing, e.g., via screwing or twisting. The body 105 may include various cross-sections, including circular, quadrilateral, pentagonal, heptagonal, hexagonal, etc. Although various dimensions for the holder 100 are contemplated, one implementation includes a body 105 having a length at least equal to the head 110, thereby allowing sufficient material for proper securement into a backing or board. According to one example, the holder 100 may include two pieces of twisted material, such as wires, twisted in a helical manner to comprise the body 105 and separated at the head 110. The wire may be any size, and may range from approximately ten (10) gauges to twenty (20) gauges, for example. In another implementation, the holder 100 may be a unitary member, for instance formed via a casting or molding process, merely as examples. In yet another implementation, the body 105 and head 110 may be separately molded or casts, and subsequently joined together, for example via an adhesive or soldering. Additionally, the holder 100 may include a pointed base 120 for additional convenience of inserting or fastening the holder 100 to a display.

The head 110 may be configured to receive a jewelry item for display. The head 110 may include two spaced members 125, 130 projecting outwardly from the body 105 and defining a space or gap. The spaced members 125, 130 may bifurcate from the body 105 and diverge from one another. For instance, spaced members 125, 130 may extend diagonally/obliquely to a center line $C_L$ of the holder 100. Thus, the head 110 and associated spaced members 125, 130 may form a substantially V-shaped component to display the jewelry item. Although the spaced members 125, 130 are illustrated as having smooth surfaces, other implementations are contemplated, including spaced members 125, 130 with jagged surfaces which may reduce slip between the jewelry item and head 110.

Additionally or alternatively, the head 110 and associated first and second members 125, 130 may comprise a first portion 135 and a second portion 140, as shown in FIG. 1. The spaced members 125, 130 may diverge or bifurcate from a juncture 145 of the body 105 and head 110 in the first portion 135, and extend axially opposite an insertion direction 160 relative to the center line $C_L$ in the second portion 140. According to one example, the first portion 135 may define an angle $\alpha$, e.g., an acute angle $\alpha$. Stated alternatively, first and second members 125, 130 in the first portion 135 may project outwards from the juncture 145 extending obliquely with respect to the center line $C_L$ of the holder 100. According to one example, the degree at which the first and second members 125, 130 diverge from one another, for instance oblique to the center line $C_L$, may be substantially equal (e.g., symmetric). The angle $\alpha$ between first and second members 125, 130 may be tailored to the particular jewelry to be displayed. According to one example, the angle $\alpha$ is approximately 25 degrees, although the angle $\alpha$ may range between approximately 10 and 80 degrees, for example. Alternatively, the head 110 may comprise an arcuate first portion 135 and/or comprise an angle $\alpha$ greater than 90 degrees (e.g., form an obtuse angle $\alpha$).

Regarding the second portion 140, on the other hand, the spaced members 125, 130 may extend axially relative to the center line $C_L$ substantially equidistant. According to one implementation, first and second members 125, 130 may extend substantially parallel to the center line $C_L$ in the second portion 140, taking into account manufacturing tolerances. Therefore, the distance between first and second member 125, 130 in the second portion 140 may be substantially equal, whereas the distance between first and second 125, 130 in the first portion 135 may gradually increase in a direction opposite an insertion direction 160. As such, the holder 100 may include an elongated body 105 that bifurcates forming a head 110. The head 110 may include a first portion 135 diverging diagonally relative to the center line $C_L$, thereby forming an acute angle $\alpha$, and a second portion 140 extending substantially parallel relative to the center line $C_L$. According to one implementation, the first spaced member 125 may be reflectionally symmetrical with the second member 130.

According to one example, the first and second members 125, 130 may each include a radially extending appendage 150 relative to the center line $C_L$. The respective appendages 150 may be coplanar and aligned along a horizontal plane. The respective appendages 150 may be disposed at least in part in the second portion 140 of the head 110. That is, the appendages 150 may be arranged on a distal end of the respective spaced members 125, 130 relative to the body 105. The radial extension of the respective appendages 150 may be substantially equidistant and/or extend any distance radially relative to the respective first and second members 125, 130 (or radially relative to the center line $C_L$) necessary to provide sufficient surface area to properly support the jewelry item. According to one example, each appendage 150 may include a width or diameter greater than the width or diameter of the associated member 125, 130. The appendages 150 may be formed as a flat wing/plate, or as a curved lip or loop as shown in FIG. 1. The appendages 150 may facilitate support of a jewelry item, and may form a stable ledge/shelf for the placement of said item for display. Further, the appendages 150 add additional surface area in which the jewelry item may contact, thereby increasing the friction between the head 110 and the jewelry item which reduces the tendency for the jewelry item to slide off the head 110. Additionally, the appendages 150 may function as a grip to facilitate insertion/retraction of the holder 100, e.g., a handgrip for screwing or pushing the holder 100 into a display.

The holder 100 may be made of any material configured to maintain rigidity, and may also include ductile and/or malleable properties. For instance, the holder 100 may be made of a metal such as copper, aluminum, tin, iron, nickel, gold, silver, etc., or of a plastic or composite, merely as examples. The material may be bendable to allow the holder 100 to be customizable to a particular need or jewelry item. For instance, the members 125, 130 may be bendable to alter the angle $\alpha$ between first and second members 125, 130, but yet retain sufficient rigidity so as not to fold under the weight of the jewelry item. That is, the first and second member 125, 130 may be bendable to increase or decrease the angle $\alpha$ between one another in the first portion 135 depending on the characteristics of the jewelry item to be displayed (e.g., size, width, etc.). Similarly, the spaced members 125, 130 may be bendable in the second portion 140, for instance, to alter the distance of between first and second member 125, 130 near the opening at the distal end of the head 110. Further, more than one material may be used, for example the head 110 and body 105 may comprise different materials, or an interior portion of the holder 100 may comprise a first material which may be surrounded by an exterior portion comprising a second material. For instance, the holder 100 may include a metallic interior and a rubber exterior, or the holder 100 may comprise a metallic or plastic interior coated with a precious metal (e.g., gold, silver, platinum, etc.) for an aesthetically pleasing design.

Additionally, the jewelry holder 100 may include a radially extending cover 155 arranged coaxially to and concentric with the body 105. The cover 155 may be configured as a disc, quadrangular, heptagonal, hexagonal, etc. The cover 155 may surround the body 105 in a circumferential direction. The cover 155 may be arranged proximate to the juncture of the body 105 and head 110. The cover 155 may include an inner perimeter which compliments the outer perimeter of the body 105 for a tight fit with the body 105. Alternatively, the cover 155 may be formed integrally with the body 105, for example the cover 155 may be molded as an integral piece of the body 105.

According to one implementation, the jewelry holder 100 may be manufactured via casting a material, such as a metal or plastic, into a mold (not shown). The mold may include the shape/design of the holder 100 illustrated in FIG. 1. The method enables for mass production of substantially identical jewelry holders 100, and consequently reduces the cost of producing such holders 100. Consequently, the jewelry holder 100 is easy and economical to manufacture. The method of manufacturing the holder 100 may include forming an elongated body 105 having helical ridges 115 and a pointed base 120, the body 105 bifurcating into a head 110 with a diverging portion first portion 135 (e.g., a V-shaped portion 135) and parallel extending members 125, 130 in a second portion 140. This step may include forming the first portion 135 with a predetermined angle $\alpha$, however depending on the material selected the angle $\alpha$ may be subsequently adjusted to conform to the particular jewelry item. Additionally, the method may include forming appendages 150 in the second portion 140 of the respective members 125, 130 on an end opposite the base 120, e.g., on respective ends of each member 125, 130 distal to the V-shaped first portion 135. The appendages 150 may be wing-shaped or looped, the latter of which is illustrated in FIG. 1. Further, the method may include arranging a radially extending cover 155 coaxial to the body 105. The cover 150 may be formed integral with the body 105, or may be placed around the body subsequently as a separate component. Additionally, the holder 100 may be coated with a second material, such as rubber, gold, copper, silver, tin, aluminum, plastic, etc. The selection of the coating may depend in part on the desired characteristics of the holder 100, e.g., aesthetically pleasing, long lasting, durable, rigidity, and/or malleability.

Figure 2:
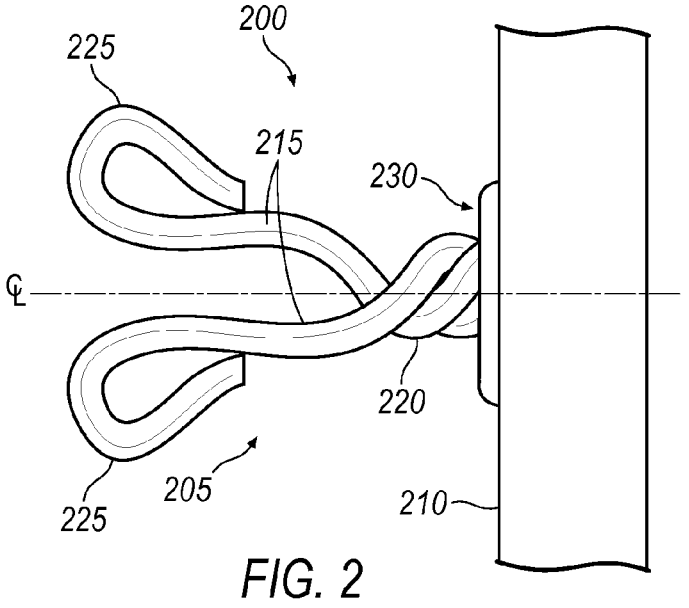
FIG. 2 illustrates a top view of an exemplary jewelry holder assembly with the holder of FIG. 1.

FIG. 2 illustrates a top view of an exemplary jewelry holder assembly 200. The assembly 200 may include a jewelry holder 205 and a container, such as a box, having a backing 210 disposed therein. The holder 205 may include the same components as holder 100 described above, such as a head 215 and body 220. The backing 210 may be configured to receive at least one holder 205. For instance, the holder 205 may be insertable into the backing 210 for a secure connection. The helical design of the elongated body 220 enables for easy insertion and removal of the holder 205 relative to the back 210, for instance to replace broken holders 205 and/or re-orient the holder 205 on the backing 210. Furthermore, the associated appendages 225 may provide an ergonomic handle to assist in re-orienting and/or removing the holders 205. The backing 210 may be made of any material, such as wood, plastic, metal, composite, or any combination thereof. The container (not shown) may include a door (not shown) configured to close the container and contain the holders 205 and jewelry items therein.

The backing 210 may be received by a wall of the container or a wall of a store, or may be an independent or transportable member configured to be arranged in a display. The backing 210 may include a board and a soft material disposed thereon. The soft material may be a non-woven or woven cloth including felt, velvet, cotton, etc. Moreover, the backing 210 may have a decorative design to further contribute to an aesthetically pleasing display. The backing 210 may have a thickness sufficient to securely receive an associated holder 205 so as to adequately maintain the holder 205 within the backing 210. The backing 210 should have enough density to be able to secure the holder 205 within it. That is, the holder 205 may be integrally attached to the backing 210 and the backing 210 may be configured to maintain the holder 205. In one example, the holder 205 may be screwed into the backing 210. In another example, the holder 205 may be nailed or glued into the backing 210. In yet another example, the backing 210 may include a plurality of pre-drilled holes configured to receive individual holders 205. The holder 205 may be inserted into the backing 210 such that only the head 215 is disposed from the backing 210. Alternatively, both the head 215 and at least part of the body 220 may be disposed exterior to the backing 210, as shown in FIG. 2.

The assembly 200 may include a cover 230 abutting the backing 210 which is configured to conceal an insertion region of the holder 205 and backing 210. The cover 230 may be arranged coaxially to the body 220 of the holder 205. As mentioned above, the cover 230 may form part of the holder 205. Alternatively, the cover 230 may be integral or attached to the backing 210, in which the holder 205 may be inserted through the cover 230 and into the backing 210. As such, the cover 230 may simultaneously function as an orienting device for the holders 205 on the backing 210, as the placement of the cover(s) 230 on the backing 210 dictates where individual holders 205 will be affixed. The cover 230 may be any configuration to sufficiently conceal the insertion of the holder 205 into the backing 210, such as annular, quadrangular, octagonal, etc.

The backing 210 may be configured to receive a plurality of holders 205. The holders 205 may project substantially perpendicular from the backing 210, although the holder 205 may include a slight upward slant relative to the backing 210 to increase stability of the jewelry item on the holder 205. The holders 205 may be aligned (e.g., horizontally, vertically, and/or diagonally) and spaced apart in staggered rows on the backing 210 to reduce the propensity of the jewelry items to tangle during transport and/or storage.

Figure 3:
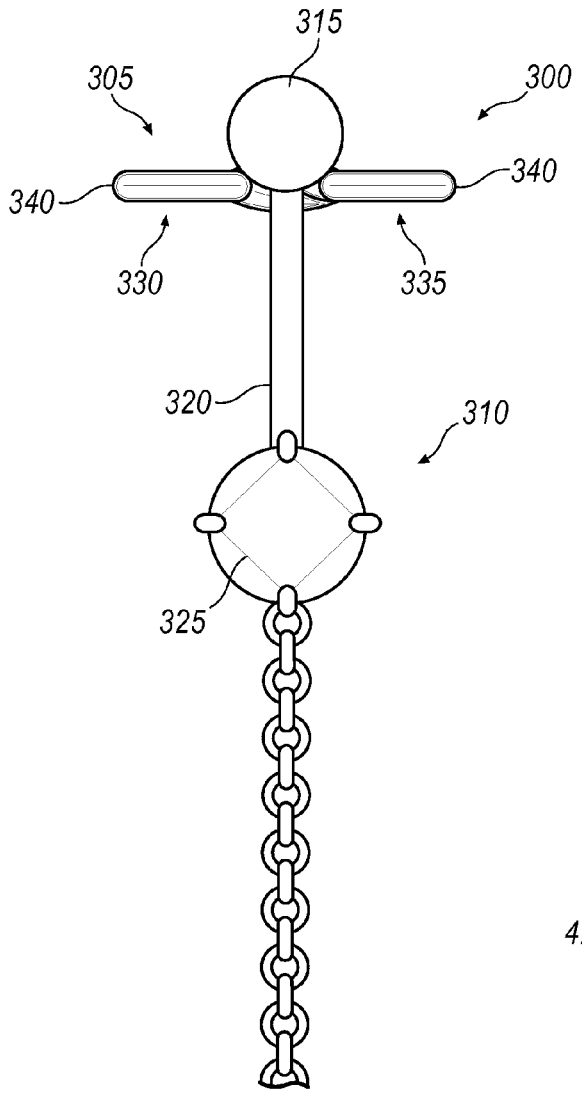
FIG. 3 illustrates a front view of the holder of the jewelry holder assembly having an item of jewelry displayed therein.

FIG. 3 illustrates a front view of a jewelry holder assembly 300 having a holder 305 supporting a jewelry item 310, for instance a navel ring. In the illustrated example, the jewelry item 310 may include a top ball 315 and a shaft 320 supporting a pendant 325. The jewelry item 310 may be arranged between first and second members 330, 335. The distance between first and second member 330, 335 may be less than the diameter of the ball 315, yet wide enough to allow the shaft 320 to freely hang there between. The angle $\alpha$ between first and second member 330, 335 may be altered depending on the characteristics of the jewelry item 310 (e.g., size, dimensions, etc.). Accordingly, the ball 315 of the jewelry item 310 may rest on the spaced members 330, 335 and the associated appendages 340. By hanging the top ball 315 on the holder 305, and in particular from first and second members 330, 335, the jewelry items 310 are configured to hang from the holder 305 for display. As such, the pendant 325 of the jewelry item 310 is visible, and thus the jewelry items 310 can be displayed in a way that is aesthetically pleasing and easily accessible.

Figure 4:
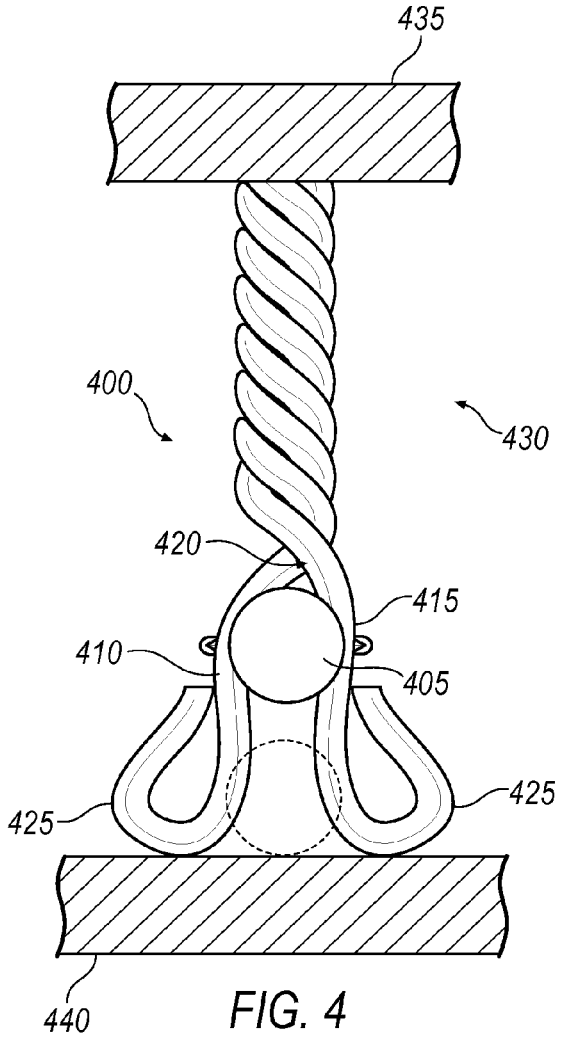
FIG. 4 illustrates a top view of the holder of the jewelry holder assembly having an item of jewelry displayed therein.

FIG. 4 illustrates a top view of a jewelry holder 400 displaying a jewelry item 405. The jewelry item 405 may be supported via bifurcating first and second members 410, 415. As shown, the underside of the jewelry item 405 engages members 410, 415, wherein the spaced members 410, 415 create a ledge for the jewelry item 405 to rest and dangle from for display. Depending on the characteristics of the jewelry item 410 (e.g., diameter, width, shape, etc.), the angle between the spaced members 410, 415 may be adjusted to properly support the jewelry item 405. While the jewelry item 405 is shown arranged near the junction of the first and second members 410, 415 (e.g., analogous to the first portion 135 of the head 110 in reference to FIG. 1), the jewelry item 405 may likewise be arranged at an end distal to the junction 420, as indicated by the dashed lines (e.g., analogous to the second portion 140 of the head 110 in reference to FIG. 1). As such, the jewelry item 405 may rest on first and second member 410, 415 and associated appendages 425. Accordingly, the gap between first and second members 410, 415 may be less than the width/diameter of the jewelry item 405 for the entire length of the respective members 410, 415 such that the jewelry item 405 may be arranged at any position there between.

As further illustrated in FIG. 4, the jewelry holder 400 may be part of a jewelry holder system 430 having a backing 435 for receiving the holder 400 and a base 440 opposite thereto. For example, the system 430 may comprise a jewelry box or container, and the backing 435 may encompass a door of the container. The length of the holder 400 extending from the backing 435 may be equivalent to the depth of the container. Thus, when the door/backing 435 closes, the end of the holder 400 (e.g., the region near the appendages 425) may abut the container base 440. By abutting the holder 400 against a surface, the jewelry 405 stored on the holder 400 (e.g., between spaced members 410, 415) will be maintained on the holder 400. That is, during traveling or storage, regardless of how the container is oriented, when the container opens (e.g., the door/backing 435 swings open), the jewelry 405 is maintained on the holder and is not altered, removed, entangled, dropped etc. while the jewelry 405 is stored. Accordingly, the jewelry 405 contained within the jewelry box is maintained in an organized manner.

Thus, described herein is a jewelry holder configured to easily and conveniently display jewelry items. The jewelry items, such as navel rings, may be easily placed and easily removed from the holder. While arranged on the holders, the jewelry items are displayed in a jewelry holder assembly so as to make selection of one easy for a user. Moreover, because the items may hang, they are not easily tangled with other items.

Accordingly, it is to be understood that the above description is intended to be illustrative and not restrictive. Many embodiments and applications other than the examples provided would be apparent upon reading the above description. The scope should be determined, not with reference to the above description, but should instead be determined with reference to the appended claims, along with the full scope of equivalents to which such claims are entitled. It is anticipated and intended that future developments will occur in the technologies discussed herein, and that the disclosed systems and methods will be incorporated into such future embodiments. In sum, it should be understood that the application is capable of modification and variation.

All terms used in the claims are intended to be given their broadest reasonable constructions and their ordinary meanings as understood by those knowledgeable in the technologies described herein unless an explicit indication to the contrary in made herein. In particular, the use of the words "first," "second," etc. may be interchangeable.

What is claimed as new and desired to be protected by Letters Patent of the United States is:

1. A jewelry holder for displaying and storing a jewelry item, comprising a shaft having:

(i) a first section to secure the jewelry holder into a backing;

(ii) a second section including two spaced members defining a gap, the two spaced members configured to receive the jewelry item; and (iii) a center line which extends from the first section to the second section;

wherein a portion of the two spaced members extends axially opposite an insertion direction of the jewelry holder;

wherein the two spaced members each include a radially extending appendage relative to the center line on an end distal to the first section;

wherein the jewelry item includes a jewelry ball with a jewelry ball diameter and a jewelry shaft with a jewelry shaft width;

wherein the gap has a width less than the jewelry ball diameter along an entire length of the two spaced members; and wherein the jewelry shaft is arranged between the two spaced members and the jewelry ball rests on the two spaced members.

2. The jewelry holder of claim 1, wherein the two spaced members diverge from one another.

3. The jewelry holder of claim 1, wherein the respective radially extending appendages are coplanar, aligned along a horizontal plane of the jewelry holder, and symmetrical.

4. The jewelry holder of claim 1, wherein the two spaced members comprise a first portion and a second portion distal to the first section, wherein the two spaced members diverge in the first portion and extend substantially equidistant and substantially parallel to the center line in the second portion.

5. The jewelry holder of claim 4, wherein at least one of the respective radially extending appendages is in a shape of a flat wing, flat plate, a curved lip, or a loop and the shape has a width greater than a width of the first portion of the associated spaced member.

6. The jewelry holder of claim 1, further comprising a radially projecting cover arranged coaxially around the shaft to conceal insertion of the jewelry holder into a backing.

7. The jewelry holder of claim 1, wherein the jewelry item includes: an earring, a navel ring, or a combination thereof.

8. A jewelry holder assembly for storing and displaying a jewelry item, comprising:

(i) a backing; and (ii) a jewelry holder projecting substantially perpendicular from the backing and configured to receive the jewelry item; wherein the jewelry holder bifurcates to include two spaced members defining a gap distal to the backing; and the jewelry holder includes a center line;

wherein the two spaced members include a first portion and a second portion distal to the backing, the two spaced members extend obliquely to the center line in the first portion and extend substantially equidistant and substantially parallel to the center line in the second portion;

wherein the jewelry item includes a jewelry ball with a jewelry ball diameter and a jewelry shaft with a jewelry shaft width, wherein the gap has a width less than the jewelry ball diameter along an entire length of the two spaced members; and wherein the jewelry shaft is arranged between the two spaced members and the jewelry ball rests on the two spaced members.

9. The jewelry holder assembly of claim 8, wherein the two spaced members each include a radially extending appendage relative to the center line on an end distal to the backing.

10. The jewelry holder assembly of claim 9, wherein the radially extending appendages are coplanar, aligned along a horizontal plane of the jewelry holder, and include a width greater than a width of the associated spaced member at the first portion.

11. The jewelry holder assembly of claim 8, further comprising a radially extending cover arranged coaxially around the jewelry holder to conceal insertion of the jewelry holder into the backing; and wherein the radially extending cover is integral with the jewelry holder.

12. The jewelry holder assembly of claim 8, wherein the jewelry holder assembly is a container comprising a base opposite the backing;

wherein a length of the jewelry holder extending from the backing is equivalent to a depth of the container which is a distance between the base and the backing; and wherein an end of the jewelry holder distal to the backing abuts the base.

13. The jewelry holder assembly of claim 8, wherein the jewelry holder includes at least one of helical ridges and external threads arranged about a perimeter of the jewelry holder.

14. A jewelry holder assembly for storing and displaying a jewelry item, comprising:

(i) a container having a backing and a base, wherein the container is able to open by having the backing swing open;

(ii) a jewelry holder having a center line coupled to the backing and configured to receive the jewelry item, wherein the jewelry holder abuts the base when the container is closed;

wherein the jewelry holder projects outwardly perpendicular to the backing and bifurcates forming a head with two spaced members defining a gap; and wherein the jewelry item includes a jewelry ball with a jewelry ball diameter and a jewelry shaft with a jewelry shaft width;

wherein the gap has a width less than the jewelry ball diameter; and wherein the jewelry shaft is arranged within the gap and the jewelry ball rests on the head.

15. The jewelry holder assembly of claim 14, wherein the head includes:

(i) a first portion where the two spaced members diverge diagonally relative to the center line; and (ii) a second portion distal to the backing where the two spaced members are substantially equidistant and substantially parallel to the center line.

16. The jewelry holder assembly of claim 15, wherein the first portion defines an acute angle.

17. The jewelry holder assembly of claim 14, wherein the head includes appendages extending radially relative to a center line of the jewelry holder, wherein the appendages are coplanar and are aligned along a horizontal plane of the jewelry holder.

18. The jewelry holder assembly of claim 14, further comprising a radially projecting cover arranged coaxially with the jewelry holder and surrounding the jewelry holder in a circumferential direction, wherein the cover is disposed between the head and the backing and conceals insertion of the jewelry holder into the backing.

* * * * *